US011852018B1

(12) United States Patent
Kittleson

(10) Patent No.: US 11,852,018 B1
(45) Date of Patent: Dec. 26, 2023

(54) TURBINE NOZZLE WITH PLANAR SURFACE ADJACENT SIDE SLASH FACE

(71) Applicant: General Electric Company, Schenectady, NY (US)

(72) Inventor: Jacob John Kittleson, Greenville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/818,760

(22) Filed: Aug. 10, 2022

(51) Int. Cl.
*F01D 11/00* (2006.01)
*F01D 9/04* (2006.01)
*F01D 11/08* (2006.01)

(52) U.S. Cl.
CPC ..... *F01D 11/001* (2013.01); *F01D 9/04* (2013.01); *F01D 11/08* (2013.01); *F05D 2220/32* (2013.01); *F05D 2240/128* (2013.01); *F05D 2240/55* (2013.01)

(58) Field of Classification Search
CPC ..... F01D 9/04; F01D 9/047; F01D 11/005; F05D 2240/80; F05D 2240/81
See application file for complete search history.

(56) References Cited

U.S. PATENT DOCUMENTS

| | | | | |
|---|---|---|---|---|
| 7,887,297 | B2 * | 2/2011 | Allen-Bradley | F01D 5/143 416/193 A |
| 8,096,746 | B2 * | 1/2012 | Durocher | F01D 9/042 415/137 |
| 8,430,626 | B1 * | 4/2013 | Liang | F01D 5/22 277/412 |
| 8,961,134 | B2 * | 2/2015 | Beeck | F01D 5/147 416/193 A |
| 9,353,638 | B2 * | 5/2016 | Rathmann | F01D 11/02 |
| 9,669,458 | B2 * | 6/2017 | Weber | B22C 9/108 |
| 10,577,955 | B2 * | 3/2020 | Shirley | F04D 29/544 |

* cited by examiner

*Primary Examiner* — Courtney D Heinle
*Assistant Examiner* — Danielle M. Christensen
(74) *Attorney, Agent, or Firm* — James Pemrick; Charlotte Wilson; Hoffman Warnick LLC

(57) ABSTRACT

A nozzle includes an endwall connected to an airfoil at one of a tip and root of the airfoil. The endwall includes a first and second side slash faces at respective circumferential edges thereof. The endwall also includes an inner surface extending between the first and second side slash faces. The inner surface includes a first planar surface portion adjacent to the first side slash face, a second planar surface portion adjacent to the second side slash face, and an arcuate surface portion extending between the first and second planar surface portions. The planar surface portions reduce a chute height by reducing hot gas path curvature locally along the side slash faces, which reduces working fluid ingestion between endwalls of the adjacent nozzles. The planar surface portions can be applied to an inner and/or an outer endwall of a nozzle.

14 Claims, 12 Drawing Sheets

TURBINE NOZZLE WITH PLANAR SURFACE ADJACENT SIDE SLASH FACE

TECHNICAL FIELD

The disclosure relates generally to gas turbine systems and, more particularly, to a turbine nozzle having an endwall having an inner surface with a planar surface portion adjacent a side slash face.

BACKGROUND

Gas turbine systems include nozzle assemblies, each including a plurality of nozzles disposed in an annular array and collectively defining a hot gas path. Adjacent nozzles in a nozzle assembly have gaps between adjacent side slash faces that are sealed with a seal to prevent ingestion of the working fluid. Ingestion of the working fluid, such as hot combustion gases, can lead to premature maintenance of the nozzles.

BRIEF DESCRIPTION

All aspects, examples, and features mentioned below can be combined in any technically possible way.

An aspect of the disclosure provides a nozzle for a turbine system, the nozzle comprising: an airfoil including a tip and a root; and an endwall connected to the airfoil at one of the tip and the root, the endwall including: a first side slash face at a first circumferential edge of the endwall; a second side slash face at a second, opposing circumferential edge of the endwall from the first circumferential edge; and an inner surface extending between the first and second side slash faces, the inner surface including a first planar surface portion adjacent to the first side slash face and a second planar surface portion adjacent to the second side slash face and an arcuate surface portion extending between the first and second planar surface portions.

Another aspect of the disclosure includes any of the preceding aspects, and the endwall further comprises a seal pocket defined axially in each side slash face, wherein the seal pockets are configured to receive a seal positioned therein for spanning a gap between adjacent nozzles.

Another aspect of the disclosure includes any of the preceding aspects, and each seal pocket has a first circumferential extent, wherein the first and second planar surface portions adjacent the first side slash face and the second side slash face each extend circumferentially from a respective circumferential edge of the respective side slash face to a second circumferential extent, wherein the second circumferential extent is greater extent than the first circumferential extent of the respective first and second seal pocket.

Another aspect of the disclosure includes any of the preceding aspects, and each seal pocket has a first circumferential extent, wherein the first and second planar surface portions adjacent the first side slash face and the second side slash face each extend circumferentially from a respective circumferential edge of the respective side slash face to a circumferential location radially aligned with the first circumferential extent of the respective first and second seal pocket at a single axial location.

Another aspect of the disclosure includes any of the preceding aspects, and each planar surface portion is angled in a non-parallel manner relative to the seal pocket.

Another aspect of the disclosure includes any of the preceding aspects, and each planar surface portion extends axially an entire extent of the respective seal pocket.

Another aspect of the disclosure includes any of the preceding aspects, and the endwall further comprises a first seal pocket defined axially in the first slash face and a second seal pocket defined axially in the second slash face, and at least one passage extending through each of the first and second side slash faces between the respective seal pocket and the respective planar surface.

Another aspect of the disclosure includes any of the preceding aspects, and the endwall includes an inner endwall connected to the tip of the airfoil, and the inner surface is convexly arcuate.

Another aspect of the disclosure includes any of the preceding aspects, and the endwall includes an outer endwall connected to the root of the airfoil, and the inner surface is concavely arcuate.

Another aspect of the disclosure includes any of the preceding aspects, and the endwall extends greater than 7° of a circumferential circular extent of the hot gas path, and each planar surface portion extends no more than 2° of the circumferential circular extent of the hot gas path.

Another aspect of the disclosure includes any of the preceding aspects, and each planar surface portion extends circumferentially in a range of 5 to 50 millimeters from the circumferential edge of a respective side slash face.

An aspect according to the disclosure includes a nozzle assembly for a turbine system, the nozzle assembly comprising: a plurality of nozzles disposed in an annular array and defining a hot gas path, each of the plurality of nozzles including: an airfoil including a tip and a root; and an endwall connected to the airfoil at one of the tip and the root, the endwall including: a first side slash face at a first circumferential edge of the endwall; a second side slash face at a second, opposing circumferential edge of the endwall from the first circumferential edge; and an inner surface extending between the first and second side slash faces, the inner surface including a first planar surface portion adjacent to the first side slash face and a second planar surface portion adjacent to the second side slash face and an arcuate surface portion extending between the first and second planar surface portions, wherein the inner surface of the endwall is configured to mate with the inner surface of the endwall of an adjacent nozzle to define a substantially curved portion of a hot gas path.

Another aspect of the disclosure includes any of the preceding aspects, and the endwall further comprises a seal pocket defined axially in each side slash face, and further comprising a seal positioned in the seal pockets of adjacent nozzles for spanning a gap between the adjacent nozzles.

Another aspect of the disclosure includes any of the preceding aspects, and each seal pocket has a first circumferential extent, wherein the first and second planar surface portions adjacent the first side slash face and the second side slash face each extend circumferentially from a respective circumferential edge of the respective side slash face to a circumferential location radially aligned with the first circumferential extent of the respective first and second seal pocket at a single axial location.

Another aspect of the disclosure includes any of the preceding aspects, and each seal pocket has a first circumferential extent, wherein the first and second planar surface portions adjacent the first side slash face and the second side slash faces each extend circumferentially from a respective circumferential edge of the respective side slash face to a second circumferential extent, the second circumferential extent being greater extent than the first circumferential extent of the respective first and second seal pocket.

Another aspect of the disclosure includes any of the preceding aspects, and each planar surface portion is angled in a non-parallel manner relative to the seal pocket.

Another aspect of the disclosure includes any of the preceding aspects, and each planar surface portion extends axially an entire extent of the respective seal pocket.

Another aspect of the disclosure includes any of the preceding aspects, and the endwall includes an inner endwall connected to the tip of the airfoil, and the inner surface is convexly arcuate.

Another aspect of the disclosure includes any of the preceding aspects, and the endwall includes an outer endwall connected to the root of the airfoil, and the inner surface is concavely arcuate.

An aspect of the disclosure relates to a gas turbine system, comprising: a compressor section; a combustor section; and a turbine section, the turbine section including a plurality of turbine stages, at least one of the plurality of turbine stages including a nozzle assembly, the nozzle assembly including a plurality of nozzles disposed in an annular array and defining a hot gas path, each of the plurality of nozzle assemblies comprising: an airfoil including a tip and a root; and an endwall connected to the airfoil at one of the tip and the root, the endwall including: a first side slash face at a first circumferential edge of the endwall; a second side slash face at a second, opposing circumferential edge of the endwall from the first circumferential edge; and an inner surface extending between the first and second side slash faces, the inner surface including a first planar surface portion adjacent to the first side slash face and a second planar surface portion adjacent to the second side slash face and an arcuate surface portion extending between the first and second planar surface portions, wherein the inner surface of the endwall is configured to mate with the inner surface of the endwall of an adjacent nozzle to define a substantially curved portion of a hot gas path.

Two or more aspects described in this disclosure, including those described in this summary section, may be combined to form implementations not specifically described herein.

The details of one or more implementations are set forth in the accompanying drawings and the description below. Other features, objects and advantages will be apparent from the description and drawings, and from the claims.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
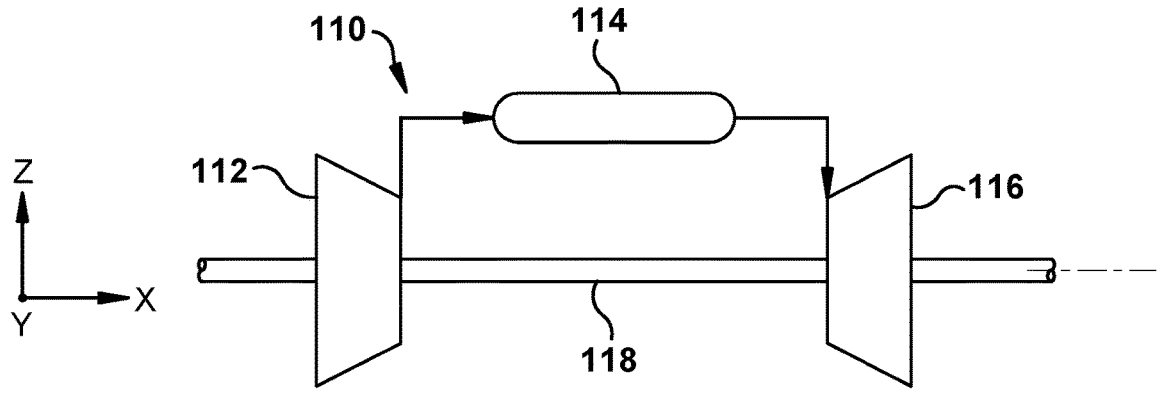
FIG. 1 is a schematic view of a turbine system (e.g., a gas turbine system), according to embodiments of the disclosure.

It is noted that the drawings of the disclosure are not necessarily to scale. The drawings are intended to depict only typical aspects of the disclosure and therefore should not be considered as limiting the scope of the disclosure. In the drawings, like numbering represents like elements between the drawings.

DETAILED DESCRIPTION

As an initial matter, in order to clearly describe the current technology, it will become necessary to select certain terminology when referring to and describing relevant machine components within a turbine system. To the extent possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, and it should prove helpful to define these terms at the onset of this section. These terms and their definitions, unless stated otherwise, are as follows. As used herein, "downstream" and "upstream" are terms that indicate a direction relative to the flow of a fluid, such as the working fluid through the turbine section or, for example, the flow of air through the combustor or coolant through one of the turbine's component systems. The term "downstream" corresponds to the direction of flow of the fluid, and the term "upstream" refers to the direction opposite to the flow. The terms "forward" and "aft," without any further specificity, refer to directions, with "forward" referring to the front or compressor end of the system, and "aft" referring to the rearward or turbine end of the system.

It is often required to describe parts that are disposed at different radial positions with regard to a center axis. The term "radial" refers to movement or position perpendicular to an axis, e.g., in a Z-direction from an X-axis of a turbine shaft. In such cases, if a first component resides closer to the axis than a second component, it will be stated herein that the first component is "radially inward" or "inboard" of the second component. If, on the other hand, the first component resides further from the axis than the second component, it may be stated herein that the first component is "radially outward" or "outboard" of the second component. The term "axial" refers to movement or position parallel to an axis, e.g., an X-axis of a turbine shaft. Finally, the term "circumferential" refers to movement or position around an axis, e.g., in a Y-plane perpendicular to an X-axis of a turbine shaft. It will be appreciated that such terms may be applied in relation to the center axis of the turbine.

In addition, several descriptive terms may be used regularly herein, as described below. The terms "first", "second", and "third" may be used interchangeably to distinguish one component from another and are not intended to signify location or importance of the individual components.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components but do not preclude the presence or addition of one or more other features, integers, steps, operations, elements, components, and/or groups thereof. "Optional" or "optionally" means that the subsequently described feature or element may or may not be present, and that the description includes instances where the feature is present and instances where it is not.

Where an element or layer is referred to as being "on," "engaged to," "connected to" or "coupled to" another element or layer, it may be directly on, engaged, connected, or coupled to the other element or layer, or intervening elements or layers may be present. In contrast, when an element is referred to as being "directly on," "directly engaged to," "directly connected to" or "directly coupled to" another element or layer, no intervening elements or layers are present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

As indicated above, a nozzle, a nozzle assembly, and a gas turbine system including the nozzle are provided. The nozzle includes an airfoil including a tip and a root. The nozzle also includes an endwall connected to the airfoil at one of the tip and the root. The endwall includes a first side slash face at a first circumferential edge thereof, and a second side slash face at a second circumferential edge thereof. The endwall also includes an inner surface extending between the first and second side slash faces. The inner surface includes a first planar surface portion adjacent to the first side slash face, a second planar surface portion adjacent to the second side slash face, and an arcuate surface portion extending between the first and second planar surface portions.

The inner surface of the endwall is configured to mate with the inner surface of the endwall of an adjacent nozzle to define a substantially curved portion of a hot gas path. The "chute" is the space between the hot gas path, defined by the arcuate inner surface portion of the endwall, and a seal spanning the gap between side slash faces of adjacent nozzles. The planar surface portions reduce the chute height by reducing hot gas path curvature locally along the side slash faces, generally matching the location of one or more seal pockets in the side slash faces. The reduced chute height reduces working fluid ingestion between endwalls of the adjacent nozzles that can lead to the need for premature maintenance. The planar surface portions can be applied to an inner and/or outer endwall of a nozzle.

FIG. 1 is a schematic diagram of an illustrative turbine system 110, such as a gas turbine system. It should be understood that turbine system 110 of the present disclosure need not be a gas turbine system 110, but rather may be any suitable turbine system, such as a steam turbine system, jet engine, or other suitable system. Turbine system 110 may include a compressor section 112, a combustor section 114, and a turbine section 116. Compressor section 112 and turbine section 116 may be coupled by a shaft 118. Shaft 118 may be a single shaft or a plurality of shaft segments coupled together to form shaft 118. Shaft defines an X axis of turbine system 110 (labeled in FIG. 2 as "TA" for "turbine axis").

As is generally known in the art, air or another suitable working fluid flows through and is compressed in compressor section 112. The compressed working fluid is then supplied to combustor section 114, wherein it is combined with fuel and combusted, creating hot combustion gases. After the hot combustion gas flows through combustor section 114, it may flow into and through turbine section 116.

Figure 2:
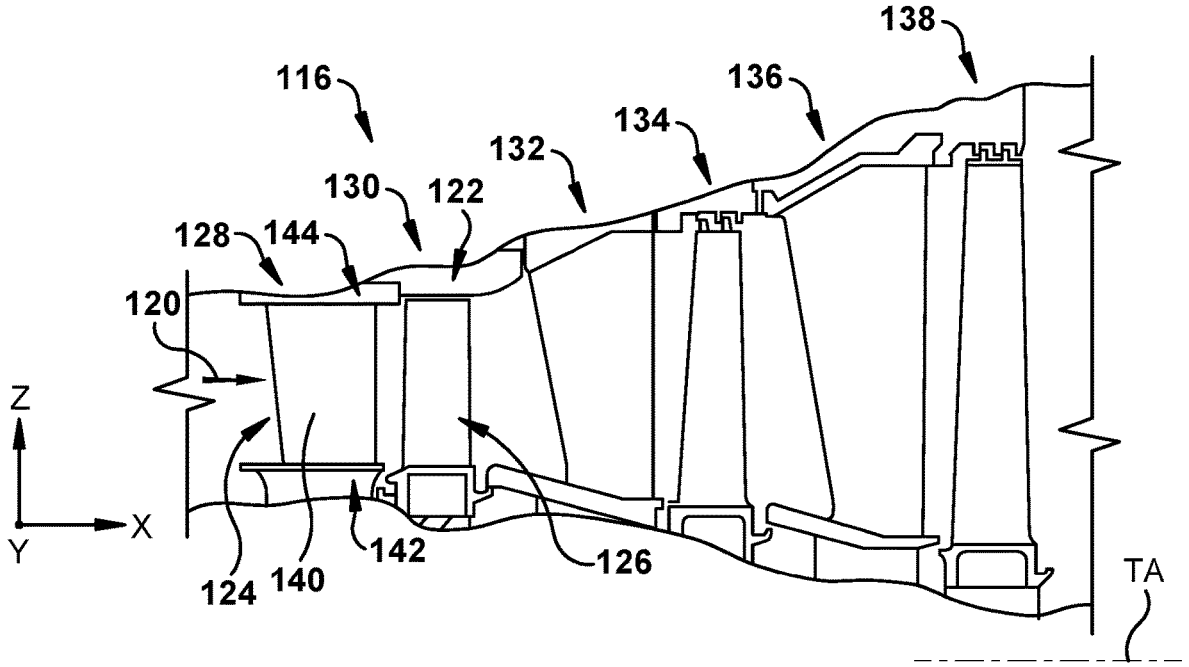
FIG. 2 is a cross-sectional view of a turbine section of a turbine system, according to embodiments of the disclosure.

FIG. 2 illustrates one embodiment of portions of turbine section 116 according to the present disclosure. A hot gas path 120 may be defined within turbine section 116. Various hot gas path components, such as shrouds 122, stationary nozzles 124, and rotating blades 126, may be at least partially disposed in hot gas path 120. For example, as shown, turbine section 116 may include a plurality of nozzles 124 and a plurality of blades 126. Further, plurality of nozzles 124 and plurality of blades 126 may be disposed in one or more annular arrays, each of which may define a portion of hot gas path 120.

Turbine section 116 may include a plurality of turbine stages. Each stage may include a plurality of nozzles 124 disposed in an annular array and a plurality of blades 126 disposed in an annular array. For example, as shown in FIG. 2, in one embodiment, turbine section 116 may have three stages. For example, a first stage of turbine section 116 may include a first stage nozzle assembly 128 and a first stage blade assembly 130. Nozzle assembly 128 may include a plurality of nozzles 124 disposed and fixed circumferentially about shaft 118. Blade assembly 130 may include a plurality of blades 126 disposed circumferentially about shaft 118 and coupled to shaft 118.

A second stage of turbine section 116 may include a second stage nozzle assembly 132 and a second stage blade assembly 134. Nozzles 124 included in nozzle assembly 132 may be disposed and fixed circumferentially about shaft 118. Blades 126 included in blade assembly 134 may be disposed circumferentially about shaft 118 and coupled to shaft 118. Second stage nozzle assembly 132 is thus positioned between first stage blade assembly 130 and second stage blade assembly 134 along hot gas path 120.

A third stage of turbine section 116 may include a third stage nozzle assembly 136 and a third stage blade assembly 138. Nozzles 124 included in nozzle assembly 136 may be disposed and fixed circumferentially about shaft 118. Blades 126 included in blade assembly 138 may be disposed circumferentially about shaft 118 and coupled to shaft 118. Third stage nozzle assembly 136 is thus positioned between second stage blade assembly 134 and third stage blade assembly 138 along hot gas path 120.

It should be understood that turbine section 116 is not limited to three stages, but rather that any number of stages are within the scope and spirit of the present disclosure. It should be understood that nozzles 124 according to the present disclosure are not limited to components in turbine sections 116. Rather, nozzles 124 may be components at least partially disposed in flow paths for compressor section 112 or any other suitable sections of turbine system 110. Further, it should be understood that the nozzles 124 in nozzle assemblies 128, 132, and 136 may be fixedly coupled to a turbine casing (not shown) that circumscribes shaft 118.

Figure 3:
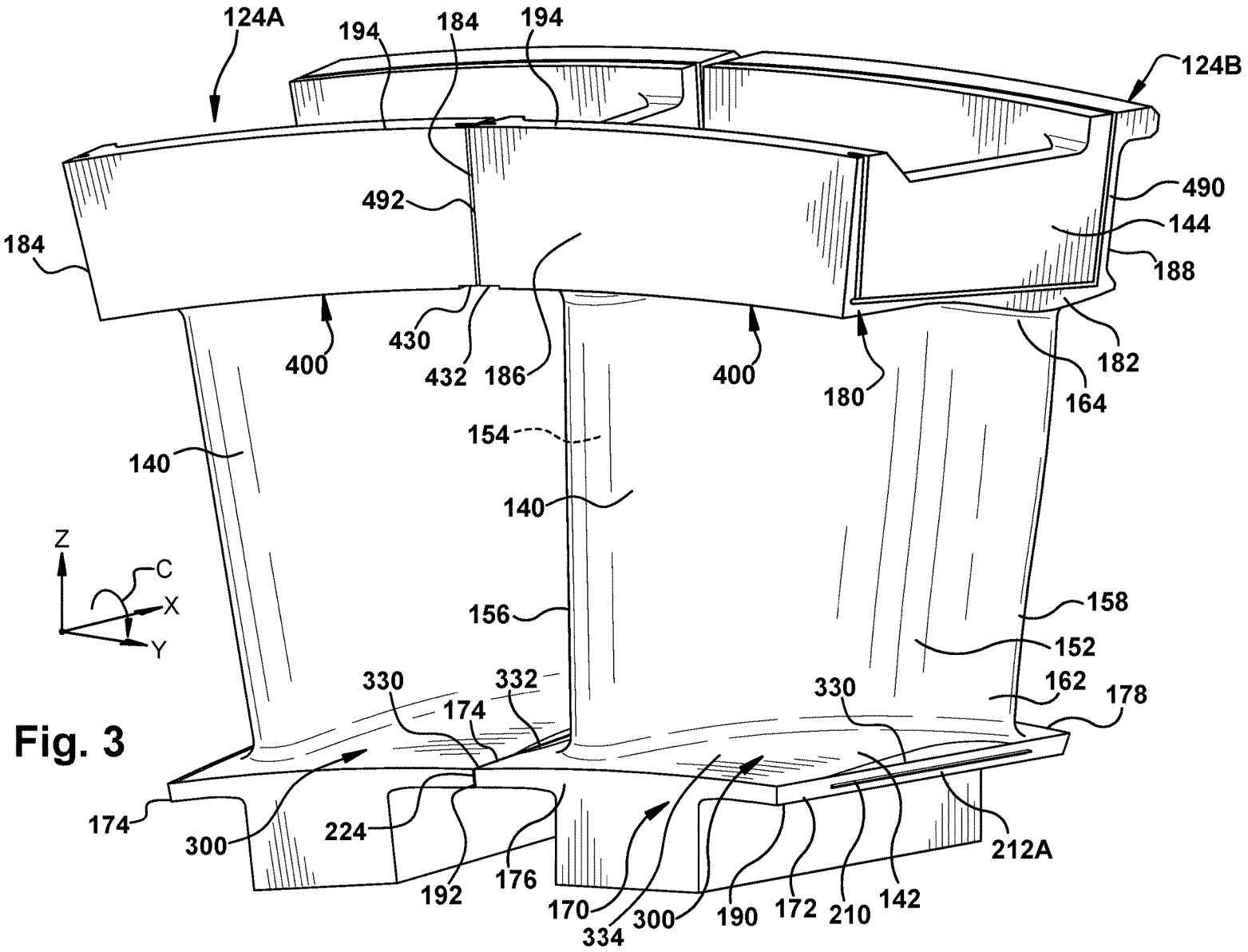
FIG. 3 is perspective view of a nozzle including an endwall, according to embodiments of the disclosure.

FIG. 3 shows a side perspective view of embodiments of a pair of adjacent singlet nozzles 124A, 124B for turbine system 110 (FIG. 1). It will be recognized that while nozzles 124 are shown as singlets, more than one airfoil 140 may be coupled to each endwall 142, 144 to form multiple nozzle 124 segments (e.g., doublets or triplets). For purposes of simplicity of description, only singlet nozzles 124 will be illustrated. It is emphasized that the teachings of the disclosure are equally applicable to multiple nozzle segments including more than one nozzle 124 coupled to respective endwalls 142, 144. In any event, nozzles 124 in illustrative embodiments may be used as a first stage nozzle 124, thus utilized in first stage nozzle assembly 128 (FIG. 2). In other embodiments, however, nozzle 124 could be a second stage nozzle 124 utilized in second stage nozzle assembly 132 (FIG. 2). In yet other embodiments, nozzle 124 can be a third stage nozzle 124 utilized in third stage nozzle assembly 138, or any other suitable nozzle utilized in any suitable stage or other assembly, in turbine section 116, compressor section 112, or otherwise.

As shown, nozzle 124 according to the present disclosure includes an airfoil 140, an inner endwall 142, and an outer endwall 144. Endwalls 142, 144 may also be referred to as sidewalls. Airfoil 140 extends between inner and outer endwalls 142, 144 and is connected thereto. Airfoil 140 includes exterior surfaces defining a pressure side 152, a suction side 154, a leading edge 156, and a trailing edge 158. As is generally known, pressure side 152 and suction side 154 each generally extend between leading edge 156 and trailing edge 158. Airfoil 140 further defines and extends between a tip 162 and a root 164. Inner endwall 142 is connected to airfoil 140 at tip 162, while outer endwall 144 is connected at root 164.

As noted, endwalls 142, 144 are connected to airfoil 140. In some embodiments, nozzle(s) 124 is/are formed as a single, unitary component, such as through casting or additive manufacture, and endwalls 142, 144 and airfoil 140 are thus integrally connected. In other embodiments, airfoil 140 and endwalls 142, 144 are formed separately and joined together. In these embodiments, airfoil 140 and endwalls 142, 144 may be welded, mechanically fastened, or otherwise connected together. As noted, each nozzle 124 includes one or more airfoils 140. Each airfoil 140 extends between and is connected to endwalls 142, 144. While one (as shown), two, three, four or more airfoils 140 may be included in nozzle 124, only one is shown for the illustrative singlet described herein.

Further, as noted, nozzle 124 may be included in an annular array of nozzles 124 as a nozzle assembly (e.g., 128, 132, 136). Embodiments of the disclosure may find special applicability for nozzle assemblies that include fewer, larger nozzles, e.g., 36 nozzles rather than a higher number such as 48. In this case, each nozzle 124 may include endwalls 142, 144 that extend arcuately greater than 8° of the annular array. In one example, a first stage nozzle assembly 128 (FIG. 2) and/or second stage nozzle assembly 132 (FIG. 2) has such nozzles 124.

As shown in FIG. 3, inner endwall 142 includes a peripheral edge 170. Peripheral edge 170 defines the periphery of inner endwall 142. In illustrative embodiments, peripheral edge 170 may thus include and define various faces, which correspond to the various surfaces of nozzle(s) 124. For example, as shown, a peripheral edge 170 of inner endwall 142 may define a pressure side slash face 172, a suction side slash face 174, a leading edge face 176, and a trailing edge face 178. Side slash faces 172, 174 are at respective circumferential edges 190, 192, respectively, of inner endwall 142, i.e., a farthest circumferentially extending edge of inner endwall 142.

Similarly, as also shown in FIG. 3, outer endwall 144 includes a peripheral edge 180. Peripheral edge 180 defines the periphery of outer endwall 144. In illustrative embodiments, peripheral edge 180 of outer endwall 144 may include and define various faces which correspond to the various surfaces of nozzle(s) 124. For example, as shown, peripheral edge 180 may define a pressure side slash face 182, a suction side slash face 184, a leading edge face 186, and a trailing edge face 188. Hence, each endwall 142, 144 includes a first (pressure) side slash face 172, 182 at a first circumferential edge 190 of the endwall, and a second (suction) side slash face 174, 184, respectively, at a second, opposing circumferential edge 192 of the endwall from first circumferential edge 190.

With continuing reference to FIG. 3, each nozzle 124 may include any now known or later developed mounting system 194 for mounting outer endwall 144 to a casing of turbine section 116. Each nozzle 124 may also include any now known or later developed stiffening member (not shown) extending circumferentially on at least one of a radially inner side of inner endwall 142 and a radially outer side of outer endwall 144.

Figure 4:
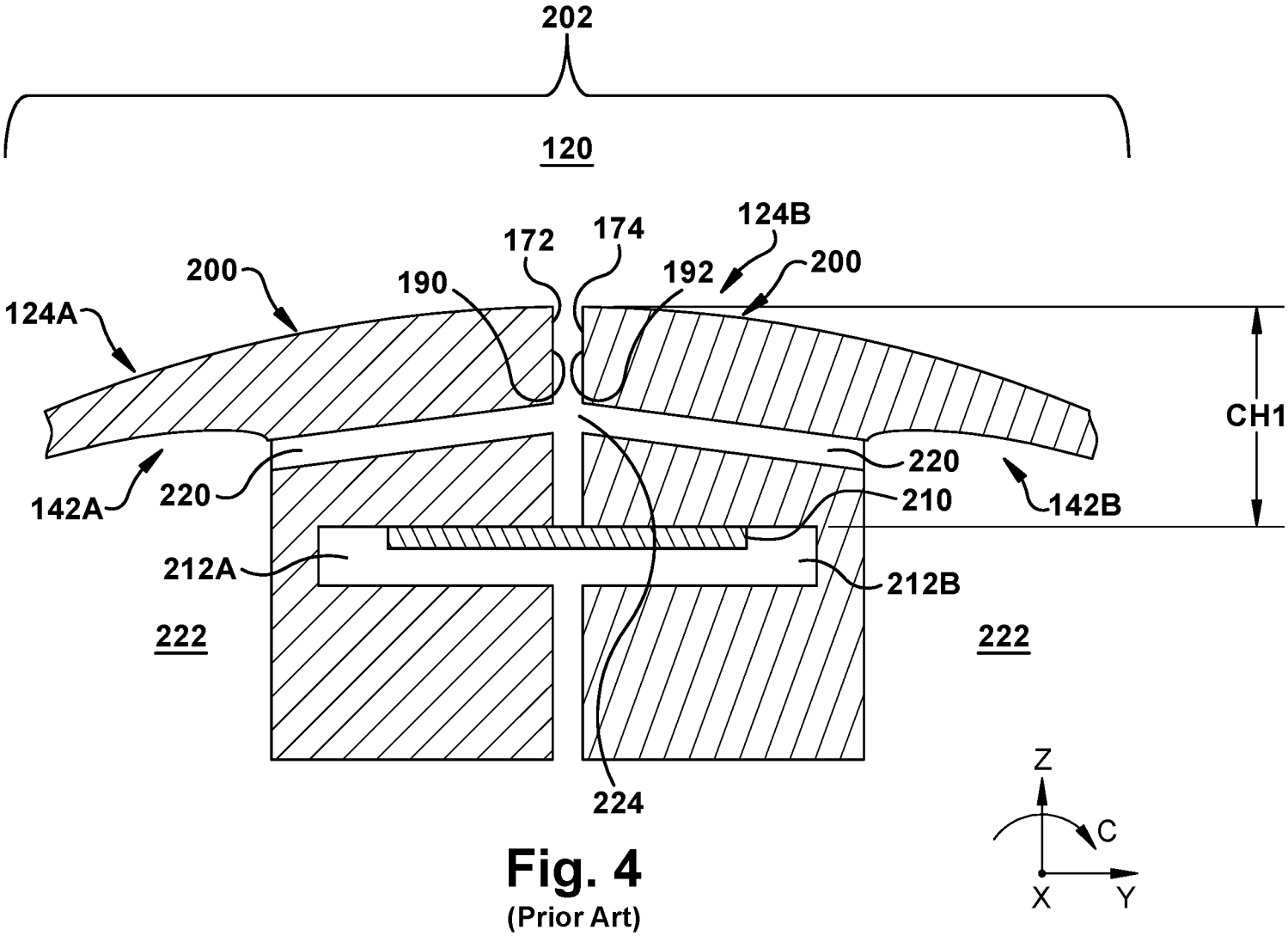
Fig. 4 (Prior Art)
FIG. 4 is a cross-sectional view of a slash face mating region of inner endwalls of a pair of conventional nozzles.
Figure 5:
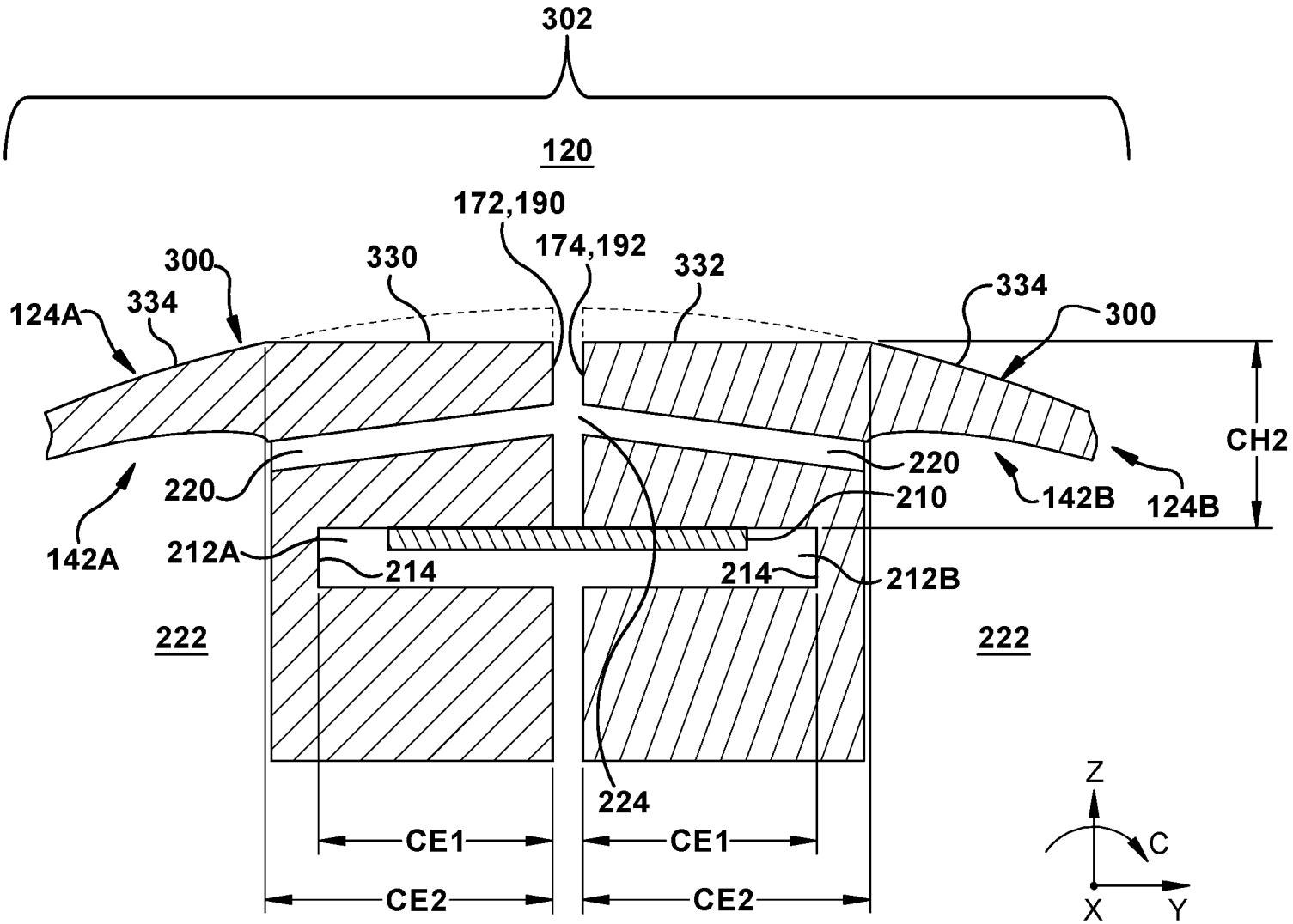
FIG. 5 is a cross-sectional view of a slash face mating region of inner endwalls of a pair of nozzles, according to embodiments of the disclosure.
Figure 6:
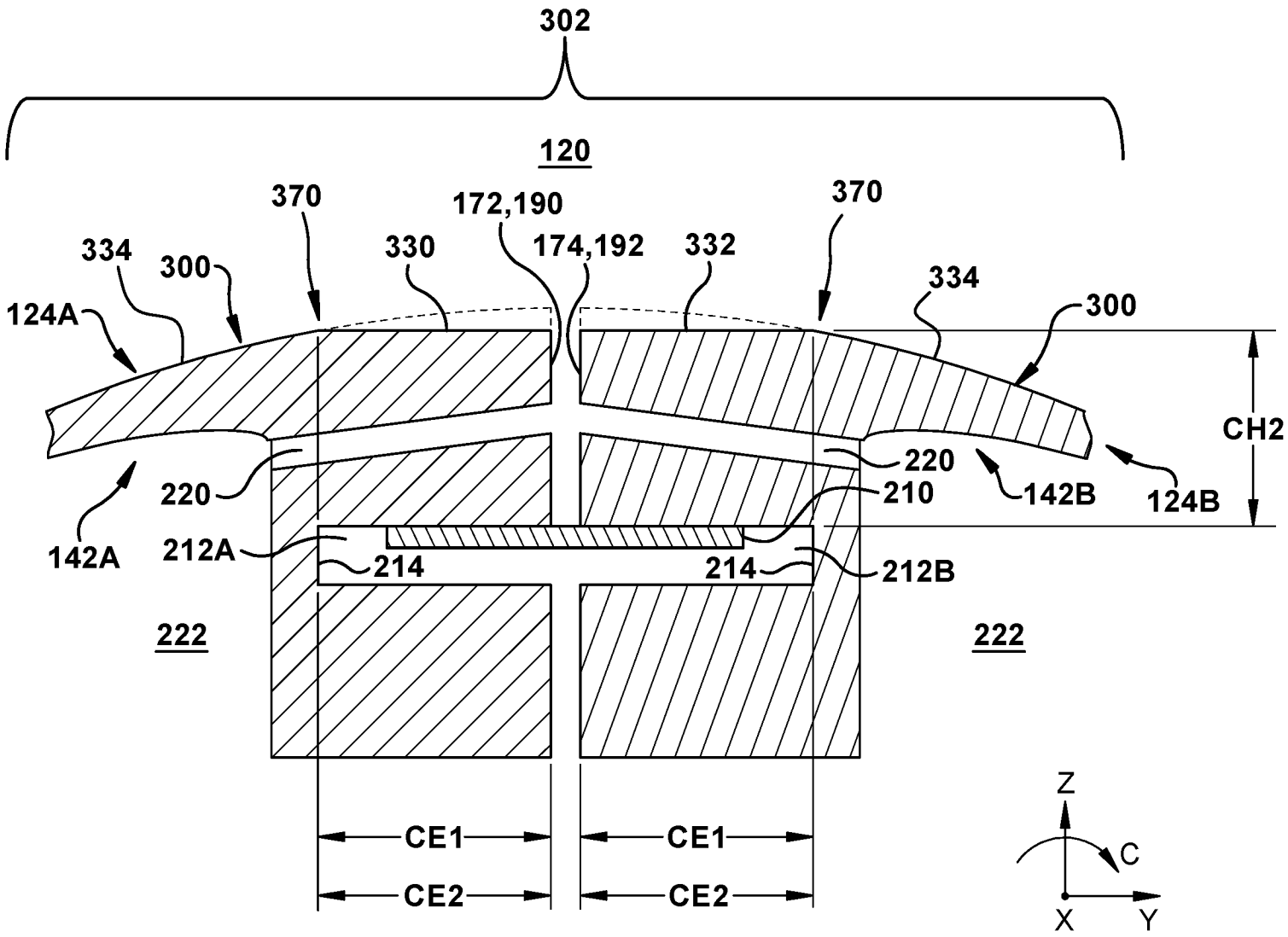
FIG. 6 is a cross-sectional view of a slash face mating region of inner endwalls of a pair of nozzles, according to other embodiments of the disclosure.

FIG. 4 shows a schematic cross-sectional view of inner endwalls 142A, 142B of adjacent nozzles 124A, 124B where side slash faces 172, 174 of the inner endwalls are structured in a conventional manner, and FIGS. 5-6 show schematic cross-sectional views of inner endwalls 142A, 142B of adjacent nozzles 124A, 124B where side slash faces 172, 174 of the inner endwalls are structured according to embodiments of the disclosure. FIGS. 4-6 view the structure from upstream of nozzles 124A, 124B (as from left in FIG. 3). The scope of FIGS. 4-6 is such that airfoils 140 are not in view therein.

As noted, inner endwalls 142 include inner endwall pressure side slash face 172 and inner endwall suction side slash face 174, each at a respective circumferential edge 190, 192 of inner endwalls 142. In FIGS. 4-6, two adjacent nozzles 124A, 124B include adjacent side slash faces 172, 174 of adjacent inner endwalls 142A, 142B. More particularly, pressure side slash face 172 of nozzle 124A is adjacent to suction side slash face 174 of nozzle 124B. Inner endwalls 142A, 142B are connected to airfoil 140 at tip 162 (FIG. 3).

As shown in FIG. 4, each inner endwall, e.g., 142A of nozzle 124A, includes an inner surface 200 configured to mate with inner surface 200 of endwall, e.g., 142B of an adjacent nozzle 124B, to define a curved portion 202 of hot gas path 120. For inner endwalls 142, curved portion 202 of inner surface 200 is convexly arcuate, so a given nozzle assembly collectively forms a radially outwardly facing substantially circular or oblong wall defining a radially inner extent of hot gas path 120. In this context, "substantially circular" indicates inner surface 200 across a given nozzle assembly is circular excepting minor deviations for the locations of gaps between slash faces 172, 174, and where airfoil 140 exists (and where planar surface portions 330, 332 exist according to embodiments of the disclosure).

In a conventional arrangement, as shown in FIG. 4, inner surfaces 200 extend in a contiguous, convexly arcuate manner to side slash faces 172, 174 where a gap or space 224 between side slash faces 172, 174 interrupts the surface. That is, inner surface 200 is, excepting where airfoil 140 is connected, convexly arcuate along its entire extent between respective side slash faces 172, 174 of inner endwall 142. A seal 210 spans between side slash faces 172, 174 of adjacent nozzles 124A, 124B to prevent ingestion of combustion gases from hot gas path 120. Seal 210 is positioned in respective seal pockets 212A, 212B defined axially inside slash faces 172, 174. Any number of seals 210 can be used within a given seal pocket 212A, 212B of a side slash face 172, 174. Further, for a given side slash face 172, 174, one or more seal and seal pocket combinations can be used with an axial extent of the given side slash face 172, 174.

In certain embodiments, at least one passage 220 may optionally extend through side slash faces 172, 174 from a wheel space 222 into a gap or space 224 between side slash faces 172, 174. Any number of passages 220 can be axially spaced alongside slash faces 172, 174 (into or out of page of FIG. 4). Passages 220 may deliver a fluid, such as air, to side slash faces 172, 174 to cool side slash faces 172, 174 and/or to prevent ingestion of hot combustion gases from hot gas path 120. A "chute height" CH1 is defined between inner surface 200 of adjacent side slash faces 172, 174 of adjacent nozzles 124A, 124B and a radial outer edge of seal pockets 212A, 212B upon which seal 210 rests, i.e., radial location of seal 210. Chute height CH1 thus extends radially through side slash faces 172, 174.

It has been discovered that reduction of chute height CH1 is beneficial to reduce ingestion of hot combustion gases from hot gas path 120. As shown in FIGS. 5-6, in accordance with embodiments of the disclosure, an inner endwall 142 may include inner surface 300 between first and second side slash faces 172, 174, excepting where airfoil 140 is connected to the endwall. Inner surface 300 includes a first planar surface portion 330 adjacent first side slash face 172 and a second planar surface portion 332 adjacent to second side slash face 174. That is, planar surface portions 330, 332 are immediately (directly) adjacent with side slash faces 172, 174.

Inner surface 300 also includes an arcuate surface portion 334 extending between first and second planar surface portions 330, 332. For inner endwall 142, arcuate surface portion 334 is convexly arcuate. Hence, inner surface 300 is generally convexly arcuate to so as to collectively form, for a given nozzle assembly, a radially outwardly facing circular wall defining a radially inner extent of hot gas path 120. Here, arcuate surface portions 334 do not extend in a contiguous manner between side slash faces 172, 174, but are disrupted by planar surface portions 330, 332 adjacent to side slash faces 172, 174 (and airfoil 140 (FIG. 3)). Hence, inner surface 300 is convexly arcuate along most of its extent except next to side slash faces 172, 174, and where airfoil 140 (FIG. 3) attaches. Inner surface 300 of inner endwall 142 is configured to mate with inner surface 300 of inner endwall 142 of an adjacent nozzle 124 to define a substantially curved portion 302 (FIGS. 5-6) of hot gas path 120, excepting where planar surface portions 330, 332 exist.

Inner endwall 142 may further include a seal pocket 212A, 212B defined axially in each side slash face 172, 174. Inner endwall 142 may also include seal 210 in respective seal pockets 212A, 212B. As noted, any number of seals 210 can be used within a given seal pocket 212A, 212B of a side slash face 172, 174, and, for a given side slash face 172, 174, one or more seal and seal pocket combinations can be used with an axial extent of the given side slash face 172, 174. Where planar surface(s) 330, 332 are used, a smaller chute height CH2 than chute height CH1 of FIG. 4 is defined between inner surface 300 (now defined by planar surfaces 330, 332) and a radial outer edge of seal pockets 212A, 212B upon which seal 210 rests, i.e., radial location of seal 210. The extent removed from the chute height can vary based on a number of factors such as but not limited to the number of nozzles 124 in a particular nozzle assembly, the stage of turbine section 116 in which used, the previous size of the chute height, and/or the existence or non-existence of passages 220. In one non-limiting example, providing planar surface portions 330, 332 may reduce a radial extent of the chute height by approximately 0.127 to 2.54 millimeters, i.e., compared to inner surface 300 without planar surface portions 330, 332. Chute height CH2, i.e., a radial distance from each planar surface portion 330, 332 to a respective seal pocket 212A, 212B, is in a range of 0.508 to 10.16 millimeters.

Figure 7:
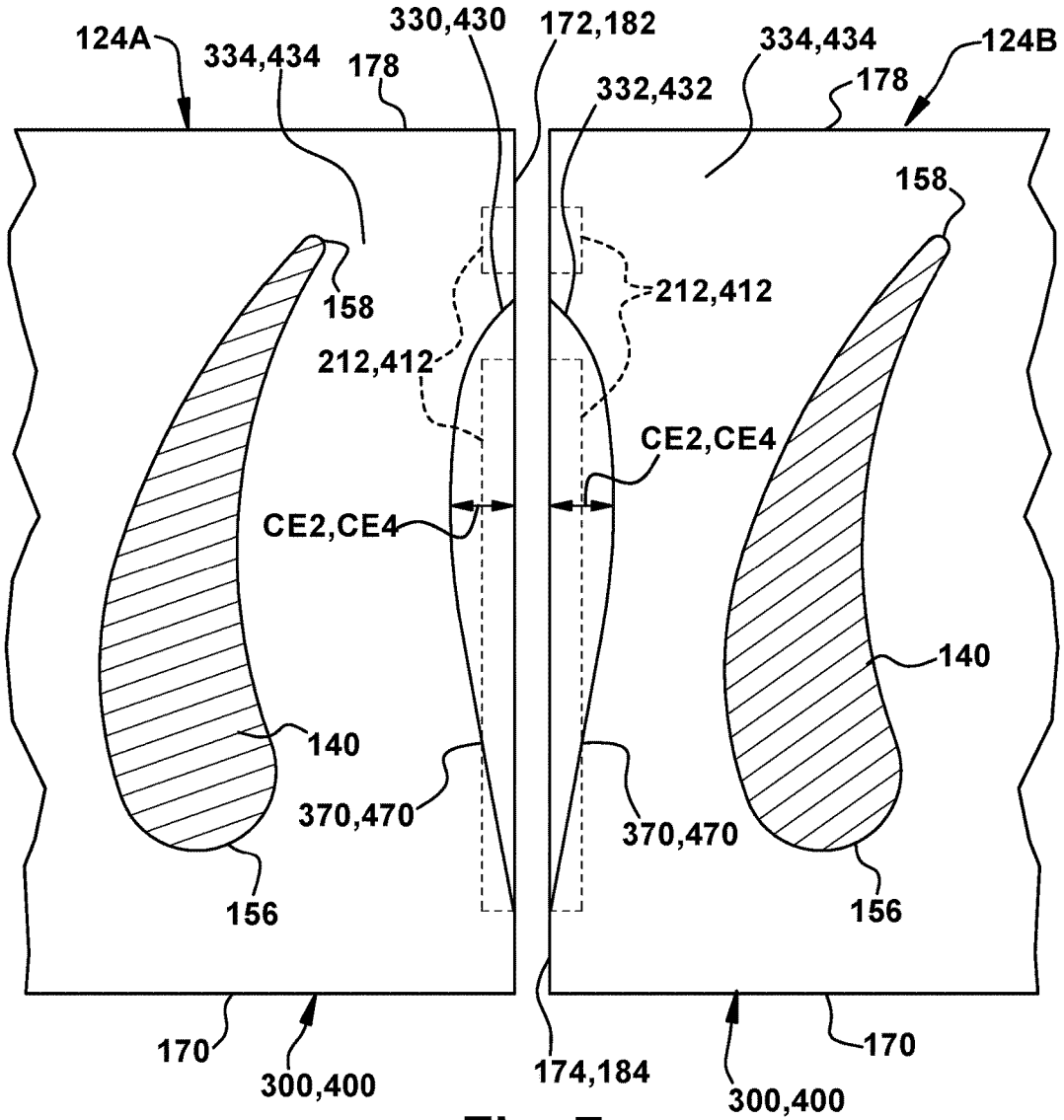
FIG. 7 is a schematic top-down view of planar surface portions, according to various embodiments of the disclosure.

FIG. 7 is a schematic top-down view of planar surface portions 330, 332 according to various embodiments of the disclosure. The circumferential extent of planar surface portions 330, 332 can vary based on a number of factors such as but not limited to the number of nozzles 124 in a particular nozzle assembly, the stage of turbine section 116 in which used, the desired chute height reduction, the previous size of the chute height, and/or the existence or non-existence of passages 220. In addition, as shown in FIGS. 5-7, the circumferential extent of planar surface portions 330, 332 can vary axially within an axial extent of a given side slash face 172, 174. Planar surface portions 330, 332 may mostly overlap with one or more seal pockets 212A, 212B in a respective side slash face 172, 174, and typically do not extend an entire axial extent of side slash faces 172, 174. Seal pockets 212A, 212B each have a circumferential extent CE1 defined from circumferential edge 190, 192 of side slash faces 172, 174, respectively, to a circumferential inner edge or side 214 of seal pockets 212A, 212B.

In certain embodiments, shown in FIG. 5, each planar surface portion 330, 332 extends circumferentially from a respective circumferential edge 190, 192 of side slash face 172, 174 to a greater extent than a respective seal pocket 212A, 212B. That is, circumferential extent CE2 of planar surface portions 330, 332 is greater than circumferential extent CE1 of a respective seal pocket 212A, 212B.

In certain embodiments, in a single axial location 370, as shown in FIG. 6, planar surfaces 330, 332 may extend circumferentially from a respective circumferential edge 190, 192 of side slash faces 172, 174 to a circumferential location radially aligned with circumferential extent CE1 of a respective seal pocket 212A, 212B at single axial location 370. That is, circumferential extent CE2 of planar surface portions 330, 332 is equal to circumferential extent CE1 of a respective seal pocket 212A, 212B. In other embodiments, circumferential extent CE2 of planar surface portion 330, 332 is equal to circumferential extent CE1 of a respective seal pocket 212A, 212B at more than one axial location, e.g., where planar surface portion 330, 332 crosses over CE1 more than once.

In other embodiments, endwall 142 may extend greater than 7° of a circumferential circular extent of hot gas path 120, and each planar surface portion 330, 332 may extend no more than 2° of the circumferential circular extent of hot gas path 120. In other embodiments, each planar surface portion 330, 332 may extend circumferentially in a range of 5 to 50 millimeters from circumferential edge 190, 192 of a respective side slash face 172, 174. While FIGS. 5 and 6 illustrate different circumferential extents of each planar surface portion 330, 332 at given axial cross-sections, as shown in the schematic top-down view of FIG. 7, the circumferential extents (CE) of each planar surface portion 330, 332 may vary along an axial extent of respective slash faces 172, 174 in any manner to, for example, maintain a desired chute height CH2 relative to a given seal pocket 212A, 212B. Any number of planar surface portions 330, 332 can be used within an axial extent of a respective side slash face 172, 174, e.g., two planar surface portions 330, 332 may be provided axially spaced along side slash faces 172, 174, each portion being over a respective slot pocket 212A, 212B.

As shown in FIGS. 5 and 6, at least one passage 220 may optionally extend through side slash faces 172, 174 from wheel space 222 into gap or space 224 between side slash faces 172, 174 and planar surface portions 330, 332. Any number of passages 220 can be axially spaced along side slash faces 172, 174 (into or out of page of FIG. 5).

In FIGS. 5-6, the endwall has been described as inner endwall 142 having inner surface 300 that is substantially convexly arcuate, i.e., except where planar surface portions 330, 332 or airfoil 140 exist. The teachings of the disclosure can also be applied to outer endwall 144.

Figure 8:
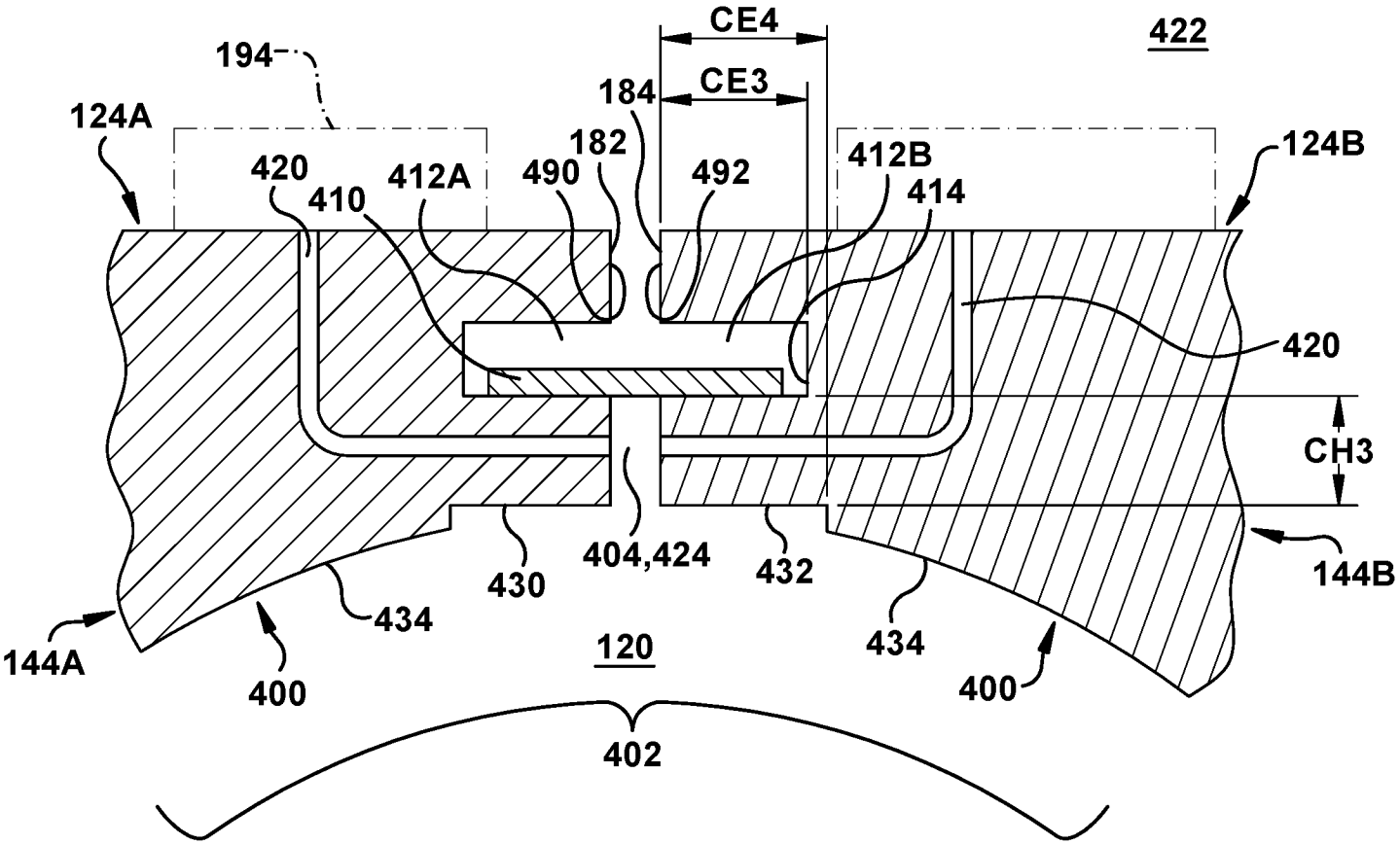
FIG. 8 is a cross-sectional view of a slash face mating region of outer endwalls of a pair of nozzles, according to embodiments of the disclosure.
Figure 9:
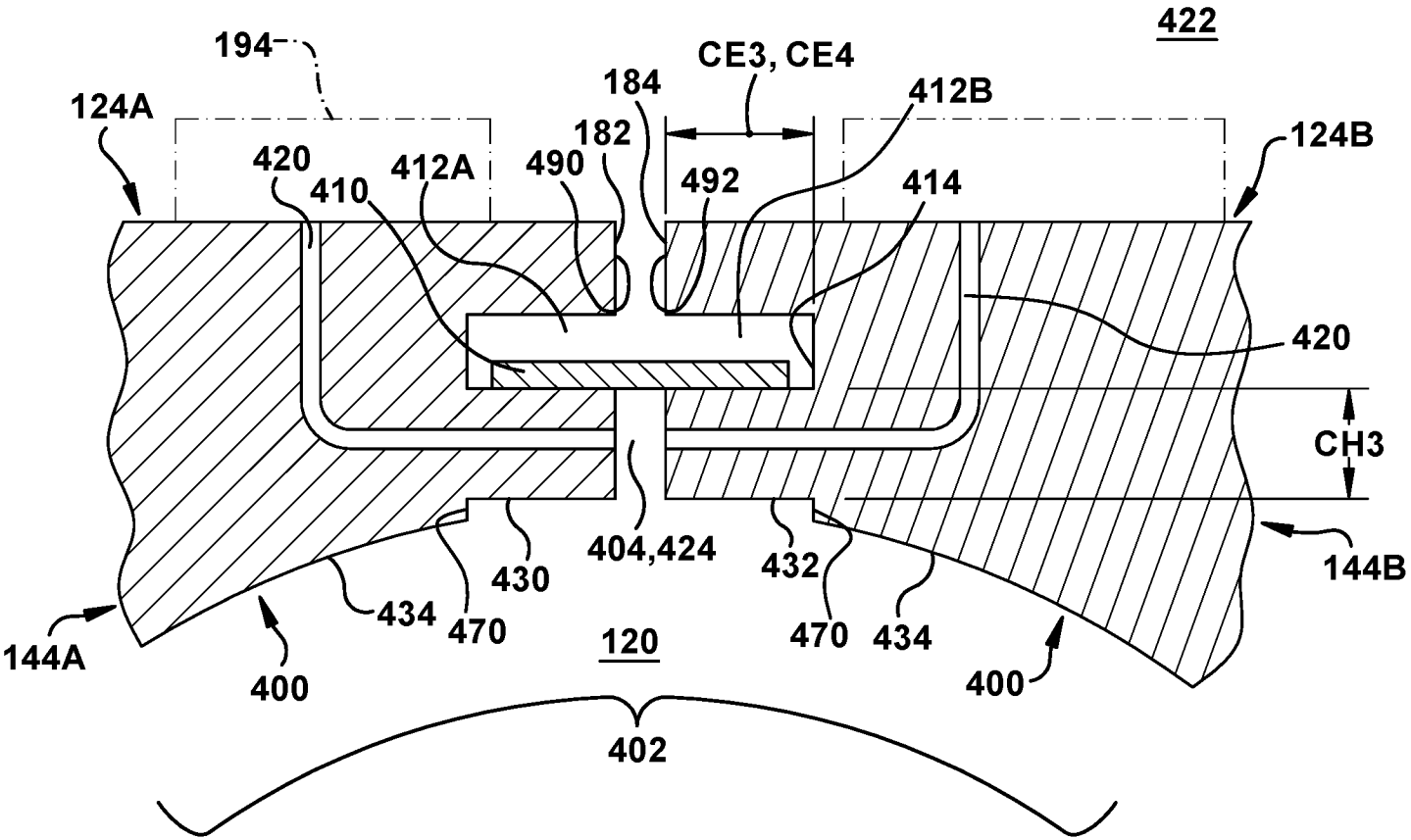
FIG. 9 is a cross-sectional view of a slash face mating region of outer endwalls of a pair of nozzles, according to other embodiments of the disclosure.

FIGS. 8 and 9 show schematic cross-sectional views of adjacent nozzles 124A, 124B where side slash faces 182, 184 of outer endwall 144 are structured according to embodiments of the disclosure. FIGS. 8 and 9 view the structure from upstream of nozzles 124A, 124B (as from left in FIG. 3). The scope of FIGS. 8-9 is such that airfoil(s) 140 are not in view. In FIGS. 8-9, two adjacent nozzles 124A, 124B include adjacent side slash faces 182, 184 of adjacent outer endwalls 144A, 144B. More particularly, a pressure side slash face 182 of nozzle 124A is adjacent to suction side slash face 184 of nozzle 124B. Outer endwalls 144A, 144B are connected to airfoil 140 at root 164 (FIG. 3). Outer endwalls 144 include outer endwall pressure side slash face 182 and outer endwall suction side slash face 184, each at a respective circumferential edge 490, 492 of outer endwall 144.

As shown in FIGS. 8-9, each outer endwall, e.g., 144A of nozzle 124A, includes an inner surface 400 configured to mate with inner surface 400 of endwall, e.g., 144B of an adjacent nozzle 124B, to define a curved portion 402 of hot gas path 120. For outer endwalls 144, curved portion 402 of inner surface 400 is concavely arcuate, to collectively form, for a given nozzle assembly, a radially inwardly facing substantially circular wall defining a radially outer extent of hot gas path 120. In this context, "substantially circular" indicates inner surface 400 across a given nozzle assembly is circular excepting minor deviations for the locations of gaps between slash faces 182, 184, where airfoil 140 exists (and where planar surface portions 430, 432 exist according to embodiments of the disclosure).

In a conventional arrangement, inner surfaces 400 extend in a contiguous, concavely arcuate manner to side slash faces 182, 184 where a gap 404 between side slash faces 182, 184 interrupts the surface. That is, inner surface 400 is concavely arcuate along its entire extent between respective side slash faces 182, 184 of outer endwall 144. A seal 410 spans between side slash faces 182, 184 of adjacent nozzles 124A, 124B to prevent ingestion of combustion gases from hot gas path 120. Seal 410 is positioned in respective seal pockets 412A, 412B defined axially inside slash faces 182, 184. Any number of seals 410 can be used within a given seal pocket 412A, 412B of a side slash face 182, 184. Further, for a given side slash face 182, 184, one or more seal and seal pocket combinations can be used with an axial extent of the given side slash face 182, 184. In certain embodiments, at least one passage 420 may optionally extend through side slash faces 182, 184 from a casing space 422 into a space 424 between side slash faces 182, 184. Any number of passages 420 can be axially spaced along side slash faces 182, 184 (into or out of page of FIGS. 8-9). Passages 420 may deliver a fluid such as air to side slash faces 182, 184 to cool side slash faces 182, 184 and/or to prevent ingestion of hot combustion gases from hot gas path 120.

Reduction of a chute height CH3 is beneficial to reduce ingestion of hot combustion gases from hot gas path 120. As shown in FIGS. 8-9, in accordance with embodiments of the disclosure, an outer endwall 144 may include inner surface 400 between first and second side slash faces 182, 184. Inner surface 400 includes a first planar surface portion 430 adjacent first side slash face 182 and a second planar surface portion 432 adjacent to second side slash face 184. That is, planar surface portions 430, 432 are immediately adjacent with side slash faces 182, 184.

Inner surface 400 also includes an arcuate surface portion 434 extending between first and second planar surface portions 430, 432. For outer endwall 144, arcuate surface portion 434 is concavely arcuate. Hence, inner surface 400 is generally concavely arcuate to collectively form, for a given nozzle assembly, a radially inwardly facing circular wall defining a radially outer extent of hot gas path 120. Here, arcuate surface portions 434 do not extend in a contiguous manner between side slash faces 182, 184, but are disrupted by planar surface portions 430, 432 adjacent to side slash faces 182, 184 (and airfoil 140 (FIG. 3)). Hence, inner surface 400 is concavely arcuate along most of its extent except next to side slash faces 182, 184. Inner surface 400 of outer endwall 144 is configured to mate with inner surface 400 of outer endwall 144 of an adjacent nozzle 124 to define a substantially curved portion 402 of hot gas path 120, except where planar surface portions 430, 432 exist.

Outer endwall 144 may further include a seal pocket 412A, 412B defined axially in each side slash face 182, 184. Outer endwall 144 may also include seal 410 in respective seal pockets 412A, 412B. As noted, any number of seals 410 can be used within a given seal pocket 412A, 412B of a side slash face 182, 184, and, for a given side slash face 182, 184, one or more seal and seal pocket combinations can be used with an axial extent of the given side slash face 182, 184. Where planar surface(s) 430, 432 are used, a smaller chute height CH3 than a chute height without planar surface portions 430, 432 is defined between inner surface 400 (now defined by planar surfaces 430, 432) and a radial inner edge of seal pockets 412A, 412B upon which seal 410 rests, i.e., radial location of seal 410. Chute height CH3 extends radially between side slash faces 182, 184.

The extent removed from the chute height and the circumferential extent of planar surface portions 430, 432 can vary based on a number of factors such as but not limited to the number of nozzles 124 in a particular nozzle assembly, the stage of turbine section 116 in which used, the previous size of the chute height, and/or the existence or non-existence of passages 420. In one non-limiting example, providing planar surface portions 430, 432 may reduce a radial extent of chute height CH3 by approximately 0.127 to 2.54 millimeters compared to the chute height without planar surface portions 430, 432. Chute height CH3, i.e., a radial distance from each planar surface portion 430, 432 to a respective seal pocket 412A, 412B, is in a range of 0.508 to 10.16 millimeters.

FIG. 7 is also a schematic top-down view of planar surface portions 430, 432 according to various embodiments of the disclosure. The circumferential extent of planar surface portions 430, 432 can vary based on a number of factors such as but not limited to the number of nozzles 124 in a particular nozzle assembly, the stage of turbine section 116 in which used, the desired chute height reduction, the previous size of the chute height, and/or the existence or non-existence of passages 220. In addition, as shown in FIGS. 7-9, the circumferential extent of planar surface portions 430, 432 can vary axially within an axial extent of a given side slash face 182, 184. Planar surface portions 430, 432 may mostly overlap with one or more seal pockets 412A, 412B in a respective side slash face 182, 184, and typically do not extend an entire axial extent of side slash faces 182, 184. Seal pockets 412A, 412B each have a circumferential extent CE3 defined from circumferential edge 490, 492 of side slash faces 182, 184, respectively, to a circumferential inner edge or side 414 of seal pockets 412A, 412B.

In certain embodiments, shown in FIG. 8, each planar surface portion 430, 432 mostly extends circumferentially from a respective circumferential edge 490, 492 of side slash face 182, 184 to a greater extent than a respective seal pocket 412A, 412B. That is, circumferential extent CE4 of planar surface portions 430, 432 is greater than circumferential extent CE3 of a respective seal pocket 412A, 412B. In certain embodiments, in a single axial location 470, as shown in FIG. 9, planar surface portion 430, 432 may extend circumferentially from a respective circumferential edge 490, 492 of side slash face 182, 184 to a circumferential location radially aligned with circumferential extent of a respective seal pocket 412A, 412B at single location 470. That is, circumferential extent CE4 of planar surface portion 430, 432 is equal to circumferential extent CE3 of a respective seal pocket 412A, 412B. In other embodiments, circumferential extent CE4 of planar surface portion 430, 432 is equal to circumferential extent CE3 of a respective seal pocket 412A, 412B at more than one axial location, e.g., where planar surface portion 430, 432 crosses over CE3 more than once.

In other embodiments, endwall 144 may extend greater than 7° of a circumferential circular extent of hot gas path 120, and each planar surface portion 430, 432 may extend no more than 2° of the circumferential circular extent of hot gas path 120. In other embodiments, each planar surface portion 430, 432 may extend circumferentially in a range of 5 to 50 mm from circumferential edge 490, 492 of a respective side slash face 182, 184.

While FIGS. 8 and 9 illustrate different circumferential extents of each planar surface portion 430, 432 at given axial cross-sections, as shown in the schematic top-down view of FIG. 7, the circumferential extents (CE) of each planar surface portion 430, 432 may vary along an axial extent of respective slash faces 182, 184 in any manner to, for example, maintain a desired chute height CH3 relative to a given seal pocket 412A, 412B. Any number of planar surface portions 430, 432 can be used within an axial extent of a respective side slash face 182, 184, e.g., two planar surface portions 430, 432 maybe provided axially spaced along side slash faces 182, 184, each portion being over a respective slot pocket 412A, 412B.

Note, FIG. 7 shows a simplified, schematic top-down view of inner and outer endwalls 142, 144 together for purposes of illustrated the different circumferential extents (CE) of planar surface portions 330, 332, 430, 432. It will be recognized that the actual pattern (circumferential extent) of planar surface portions 330, 332, 430, 432 and those of arcuate portions 334, 434, among other structures such as the cross-sectional shapes of airfoils 140, would be different for each particular endwall 142, 144, i.e., they would not be identical as illustrated.

As shown in FIGS. 8 and 9, at least one passage 420 may optionally extend through side slash faces 182, 184 from casing space 422 into space 424 between side slash faces 182, 184 and planar surface portions 430, 432. Any number of passages 420 can be axially spaced alongside slash faces 182, 184 (into or out of page of FIGS. 7 and 8).

Figure 10:
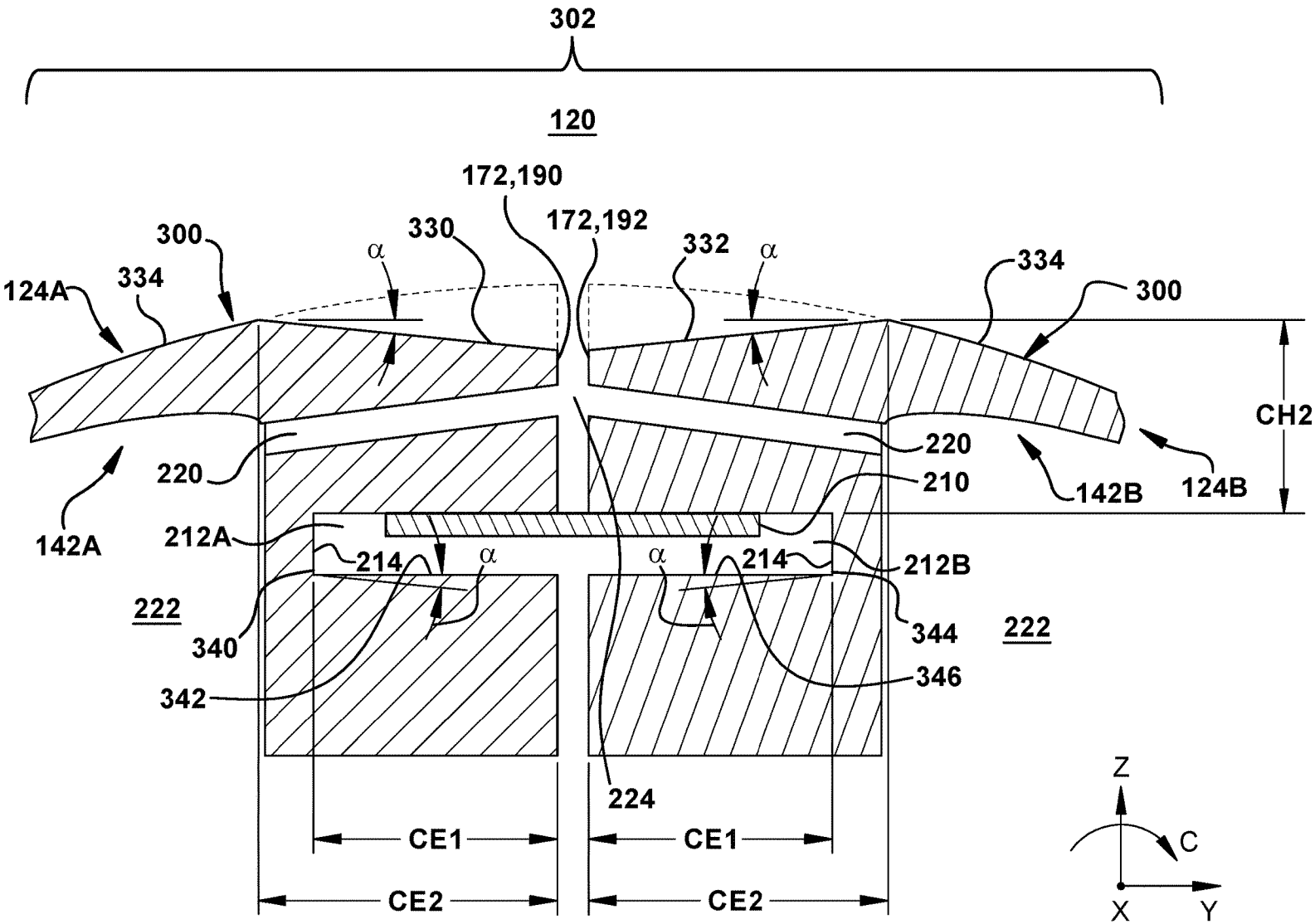
FIG. 10 is a cross-sectional view of a slash face mating region of outer endwalls of a pair of nozzles, according to alternative embodiments of the disclosure.
Figure 11:
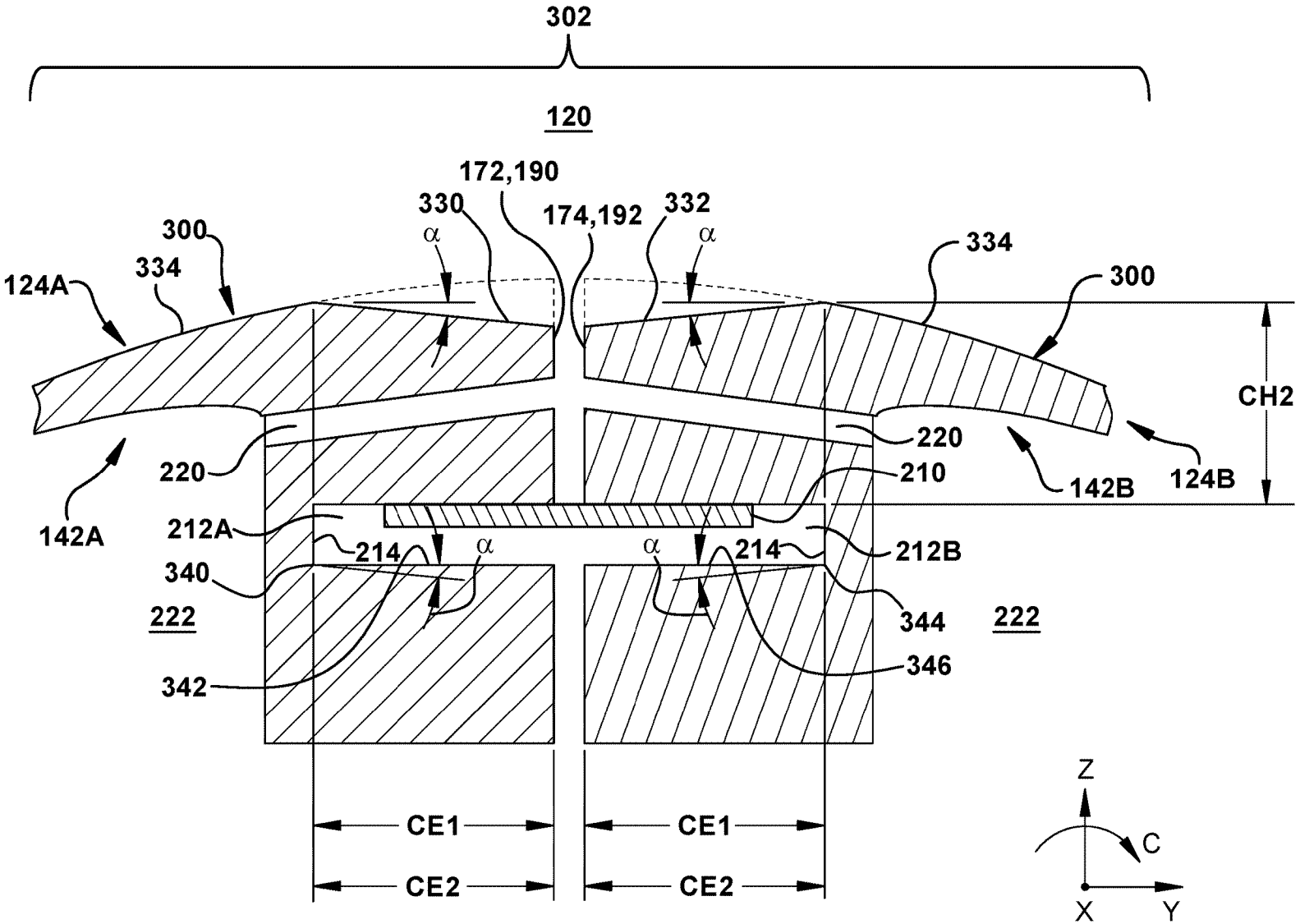
FIG. 11 is a cross-sectional view of a slash face mating region of outer endwalls of a pair of nozzles, according to alternative embodiments of the disclosure.

FIGS. 10-13 show cross-sectional views of alternative embodiments. FIGS. 10-13 are similar to FIGS. 5, 6, 8 and 9 except planar surface portions 330, 332, 430, 432 are also angled toward respective seal pockets 212A, 212B, 412A, 412B. In FIGS. 10 and 11, planar surface portions 330, 332 are angled radially inwardly toward seal pockets 212A, 212B each at an angle α, respectively; and in FIGS. 12 and 13, planar surface portions 430, 432 are angled radially outwardly toward seal pockets 412A, 412B each at an angle β.

In FIGS. 10 and 11, angles α are defined relative to a circumferentially outermost corner 340 of seal pocket 212A and a radially inward-facing surface 342 of seal pocket 412A or a circumferentially outermost corner 344 of seal pocket 212B and a radially inward-facing surface 346 of seal pocket 412B, each corner at circumferential extent CE1. As shown in FIGS. 10 and 11, planar surface portions 330, 332 are parallel to the angled line created at those locations. In this manner, each planar surface portion 330, 332 is angled in a non-parallel manner relative to a respective seal pocket 212A, 212B, i.e., the seal pocket radially aligned therewith.

Figure 12:
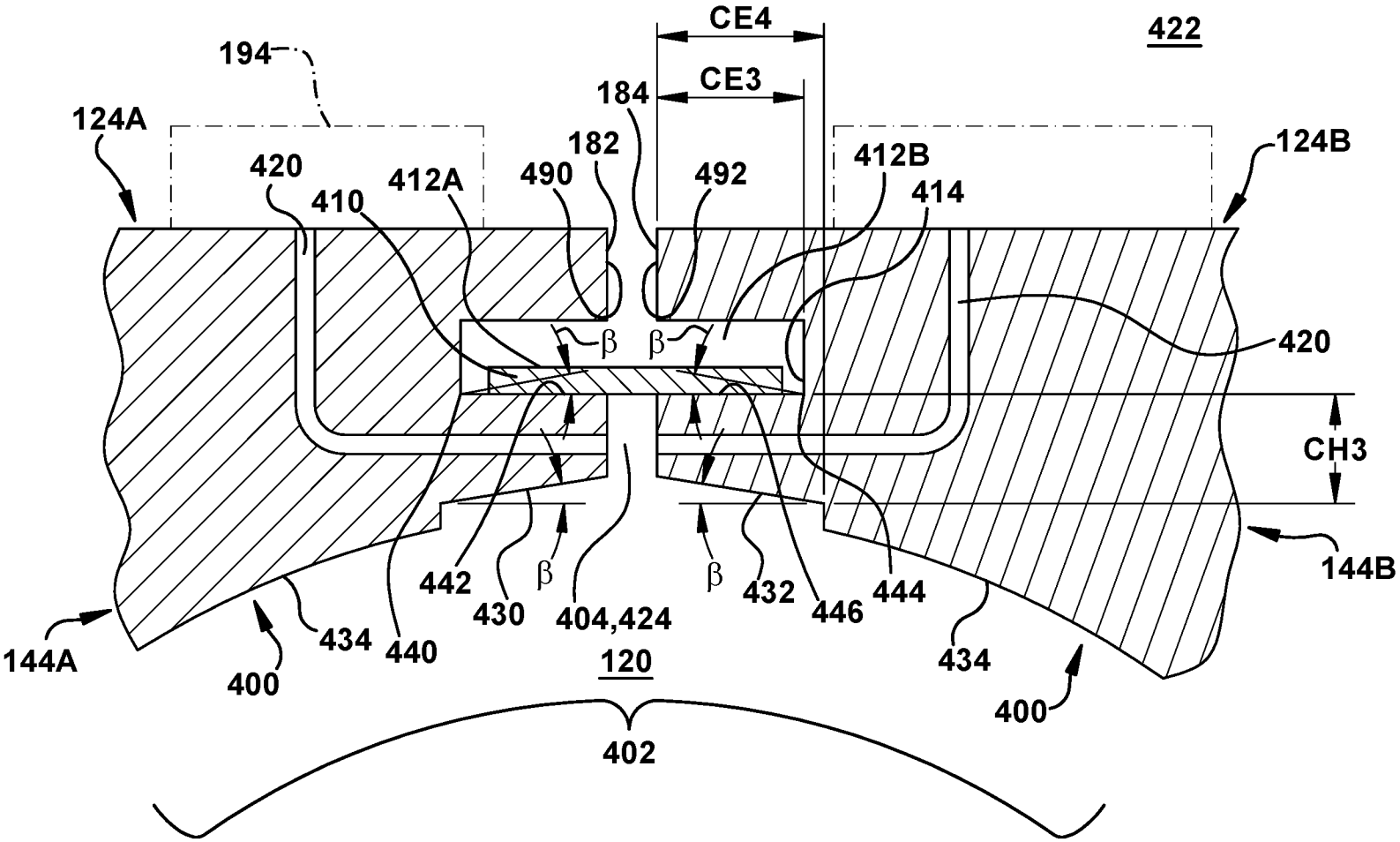
FIG. 12 is a cross-sectional view of a slash face mating region of outer endwalls of a pair of nozzles, according to alternative embodiments of the disclosure.
Figure 13:
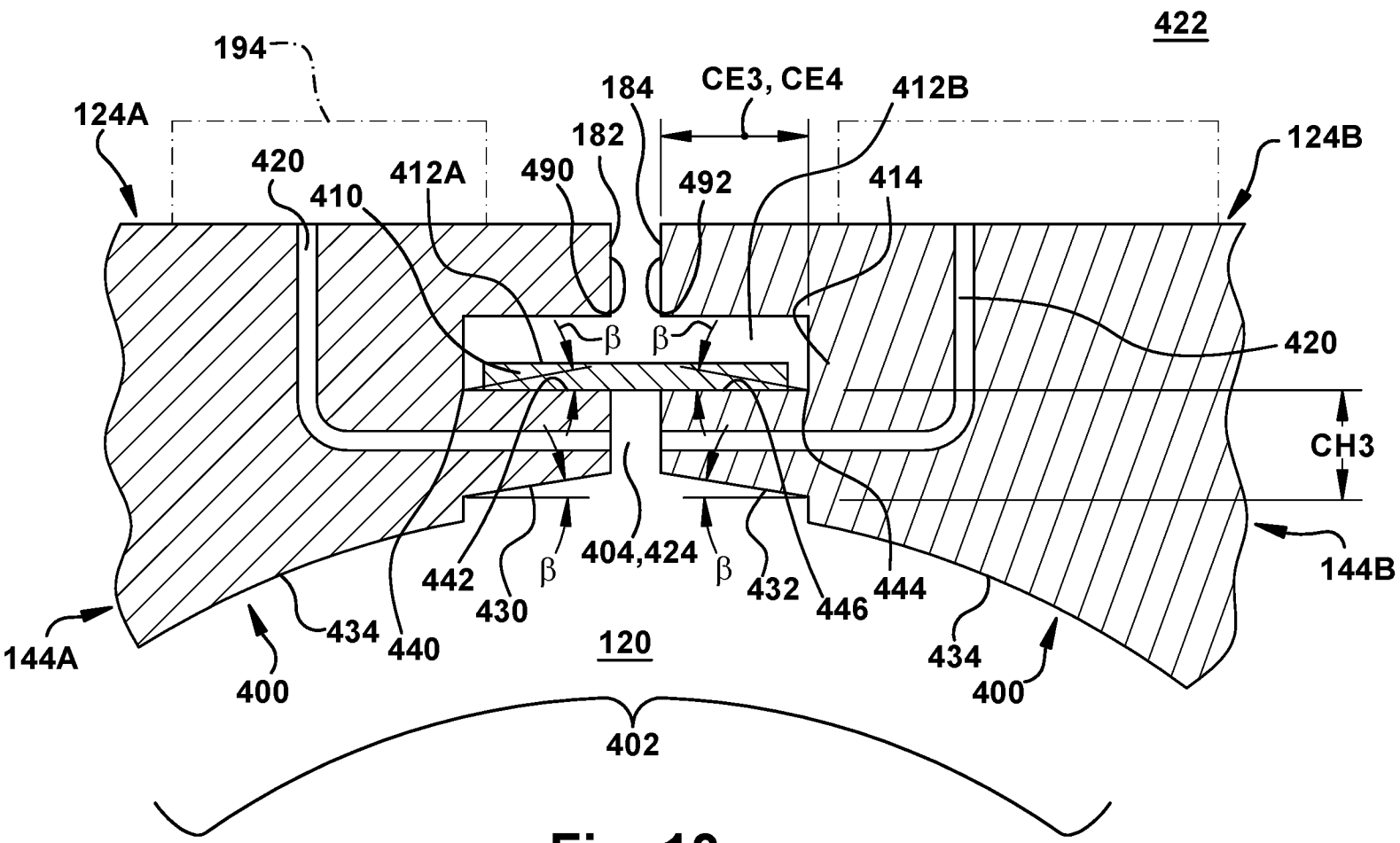
FIG. 13 is a cross-sectional view of a slash face mating region of outer endwalls of a pair of nozzles, according to alternative embodiments of the disclosure.

In FIGS. 12 and 13, angles β are defined relative to a circumferentially outermost corner 440 of seal pocket 412A and a radially outward-facing surface 442 of seal pocket 412A or a circumferentially outermost corner 444 of seal pocket 412B and a radially outward-facing surface 446 of seal pocket 412B, each corner at circumferential extent CE3. As shown in FIGS. 12 and 13, planar surface portions 430, 432 are parallel to the angled line created at those locations. In this manner, each planar surface portion 430, 432 is angled in a non-parallel manner relative to a respective seal pocket 412A, 412B, i.e., the seal pocket radially aligned therewith. Angle(s) α and angle(s) β can be, for example, between 5° and 15°. The use of angled planar surface portions 330, 332, 430, 432 may find advantage relative to larger GT systems, e.g., a General Electric HA model system, where the interaction of a curved flow path with airfoil fillets is more profound.

In certain embodiments, planar surface portions 330, 332, 430, 432 can be applied to every set of mating side slash faces 172, 174 of inner endwall 142 and/or side slash faces 182, 184 of outer endwall 144, respectively, in nozzle assembly for a given stage of turbine section 116. In other embodiments, planar surface portions 330, 332, 430, 432 can be applied to selected sets of mating side slash faces 172, 174 of inner endwall 142 and/or side slash faces 182, 184 of outer endwall 144, respectively, in a nozzle assembly for a stage of turbine section 116. In this case, the other sets may include inner surfaces 300, 400 that are contiguously arcuate, i.e., devoid of planar surfaces 330, 332, 430, 432.

While not shown for clarity, nozzles 124 according to embodiments of the disclosure may include any now known or later developed protective coatings thereon, such as a thermal barrier or similar coating. Such protective coatings, if present, are applied to the entirety of inner surfaces 300, 400, including planar surfaces 330, 332, 430, 432.

Embodiments of the disclosure provide various technical and commercial advantages, examples of which are discussed herein. Planar surface portions in endwalls reduce hot gaps along singlet nozzle slash faces and chords by locally reducing chute height. The reduction in chute height also moves the seals as close to the hot gas path as possible, which can allow a reduction in the passages required for cooling.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise. "Approximately," as applied to a particular value of a range, applies to both end values and, unless otherwise dependent on the precision of the instrument measuring the value, may indicate +/−110% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. The embodiments were chosen and described in order to best explain the principles of the disclosure and their practical application and to enable others of ordinary skill in the art to understand the disclosure such that various modifications as are suited to a particular use may be further contemplated.

What is claimed is:

1. A nozzle for a turbine system, the nozzle comprising:
- an airfoil including a tip and a root; and
- an endwall connected to the airfoil at one of the tip and the root, the endwall including:
  - a first side slash face at a first circumferential edge of the endwall;
  - a second side slash face at a second, opposing circumferential edge of the endwall from the first circumferential edge;
  - a seal pocket defined axially in each side slash face, wherein the seal pocket of each side slash face is configured to receive a seal positioned therein for spanning a gap between adjacent nozzles, each seal pocket having a first circumferential extent; and
  - an inner surface extending between the first and second side slash faces, the inner surface including a first planar surface portion adjacent to the first side slash face and a second planar surface portion adjacent to the second side slash face and an arcuate surface portion extending from and starting at the first planar surface portion to and stopping at the second planar surface portion, the arcuate surface portion being one of generally concave or generally convex, wherein the first planar surface portion and the second planar surface portion each extend circumferentially from and start at a respective circumferential edge of the respective side slash face, and wherein the first planar surface portion and the second planar surface portion each extend circumferentially to and stop at a circumferential location radially aligned with the first circumferential extent of each respective seal pocket at a single axial location.

2. The nozzle of claim 1, wherein each planar surface portion is angled in a non-parallel manner relative to the respective seal pocket.

3. The nozzle of claim 1, wherein each planar surface portion extends axially over an entire extent of the respective seal pocket.

4. The nozzle of claim 1, wherein at least one passage extends through each of the first and second side slash faces between the respective seal pocket and the respective planar surface.

5. The nozzle of claim 1, wherein the endwall includes an inner endwall connected to the tip of the airfoil, and the inner surface is convexly arcuate.

6. The nozzle of claim 1, wherein the endwall includes an outer endwall connected to the root of the airfoil, and the inner surface is concavely arcuate.

7. The nozzle of claim 1, wherein the endwall extends greater than 7° of a circumferential circular extent of a hot gas path of the turbine system, and each planar surface portion extends no more than 2° of the circumferential circular extent of the hot gas path.

8. The nozzle of claim 1, wherein each planar surface portion extends circumferentially in a range of 5 to 50 millimeters from the circumferential edge of a respective side slash face.

9. A nozzle assembly for a turbine system, the nozzle assembly comprising:
- a plurality of nozzles disposed in an annular array and defining a hot gas path, each of the plurality of nozzles including:
  - an airfoil including a tip and a root; and
  - an endwall connected to the airfoil at one of the tip and the root, the endwall including:
    - a first side slash face at a first circumferential edge of the endwall;
  - a second side slash face at a second, opposing circumferential edge of the endwall from the first circumferential edge;
  - a seal pocket defined axially in each side slash face, wherein the seal pocket of each side slash face is configured to receive a seal positioned therein for spanning a gap between adjacent nozzles, each seal pocket having a first circumferential extent, and
  - an inner surface extending between the first and second side slash faces, the inner surface including a first planar surface portion adjacent to the first side slash face and a second planar surface portion adjacent to the second side slash face and an arcuate surface portion extending from and starting at the first planar surface portion to and stopping at the second planar surface portion, the arcuate surface portion being one of generally concave or generally convex, wherein the inner surface of the endwall is configured to mate with the inner surface of the endwall of an adjacent nozzle to define a substantially curved portion of a hot gas path, wherein the first planar surface portion and the second planar surface portion each extend circumferentially from and start at a respective circumferential edge of the respective side slash face, and wherein the first planar surface portion and the second planar surface portion each extend circumferentially to and stop at a circumferential location radially aligned with the first circumferential extent of each respective seal pocket at a single axial location.

10. The nozzle assembly of claim 9, each planar surface portion is angled in a non-parallel manner relative to the respective seal pocket.

11. The nozzle assembly of claim 9, wherein each planar surface portion extends axially over an entire extent of the respective seal pocket.

12. The nozzle assembly of claim 9, wherein the endwall includes an inner endwall connected to the tip of the airfoil, and the inner surface is convexly arcuate.

13. The nozzle assembly of claim 9, wherein the endwall includes an outer endwall connected to the root of the airfoil, and the inner surface is concavely arcuate.

14. A gas turbine system, comprising:

a compressor section;

a combustor section downstream of the compressor section; and a turbine section downstream of the combustor section, the turbine section including a plurality of turbine stages, at least one of the plurality of turbine stages including a nozzle assembly, the nozzle assembly including a plurality of nozzles disposed in an annular array and defining a hot gas path, each of the plurality of nozzle assemblies comprising:

an airfoil including a tip and a root; and an endwall connected to the airfoil at one of the tip and the root, the endwall including:

a first side slash face at a first circumferential edge of the endwall;

a second side slash face at a second, opposing circumferential edge of the endwall from the first circumferential edge;

a seal pocket defined axially in each side slash face, wherein the seal pocket of each side slash face is configured to receive a seal positioned therein for spanning a gap between adjacent nozzles, each seal pocket having a first circumferential extent; and an inner surface extending between the first and second side slash faces, the inner surface including a first planar surface portion adjacent to the first side slash face and a second planar surface portion adjacent to the second side slash face and an arcuate surface portion extending from and starting at the first planar surface portion to and stopping at the second planar surface portion, the arcuate surface portion being one of generally concave or generally convex, wherein the inner surface of the endwall is configured to mate with the inner surface of the endwall of an adjacent nozzle to define a substantially curved portion of a hot gas path, wherein the first planar surface portion and the second planar surface portion each extend circumferentially from and start at a respective circumferential edge of the respective side slash face, and wherein the first planar surface portion and the second planar surface portion each extend circumferentially to and stop at a circumferential location radially aligned with the first circumferential extent of each respective seal pocket at a single axial location.

* * * * *